United States Patent [19]

Golbeck et al.

[11] 3,952,175

[45] Apr. 20, 1976

[54] PUSHBUTTON SWITCH MECHANISM HAVING BLOCK OUT MEMBERS WITH COMMON MOUNTING AND DISCRETE LATCH BAR

[75] Inventors: Bernard J. Golbeck, Crystal Lake; Raymond F. Lewandowski, Mount Prospect, both of Ill.

[73] Assignee: Oak Industries Inc., Crystal Lake, Ill.

[22] Filed: Sept. 18, 1974

[21] Appl. No.: 506,972

[52] U.S. Cl. ..... 200/5 E; 74/483 PB; 200/5 EA; 200/295; 200/328; 200/50 C

[51] Int. Cl.[2] ..... H01H 9/26

[58] Field of Search..... 200/1 R, 5 R, 5 B–5 EB, 200/293–296, 328, 50 C; 74/483 PB

[56] References Cited

UNITED STATES PATENTS

| | | | |
|---|---|---|---|
| 3,117,207 | 1/1964 | Baldasare | 200/5 EA X |
| 3,149,208 | 9/1964 | Anderson | 200/328 X |
| 3,271,530 | 9/1966 | Wirsching | 200/5 EA |
| 3,283,087 | 11/1966 | Appel | 200/328 X |
| 3,412,225 | 11/1968 | Rogers et al. | 200/295 X |
| 3,420,969 | 1/1969 | Edwards et al. | 200/328 X |
| 3,659,061 | 4/1972 | Andreaggi | 200/5 EA |
| 3,663,780 | 5/1972 | Golbeck | 200/294 X |
| 3,778,565 | 12/1973 | Lewandowski et al. | 200/5 EA X |
| 3,780,236 | 12/1973 | Gross | 200/5 EA |
| 3,797,357 | 3/1974 | Thomas et al. | 200/1 R X |

*Primary Examiner*—James R. Scott
*Attorney, Agent, or Firm*—Kinzer, Plyer, Dorn & McEachran

[57] ABSTRACT

A pushbutton switch mechanism includes a two-piece housing, a plurality of terminals positioned in the housing, a plurality of contact arms and a pivotally movable latch member within the housing. One of the housing sections has integrally molded pushbuttons mounted on integrally molded spring arms with the other housing section including integrally molded blockout members.

16 Claims, 14 Drawing Figures fig. 7.
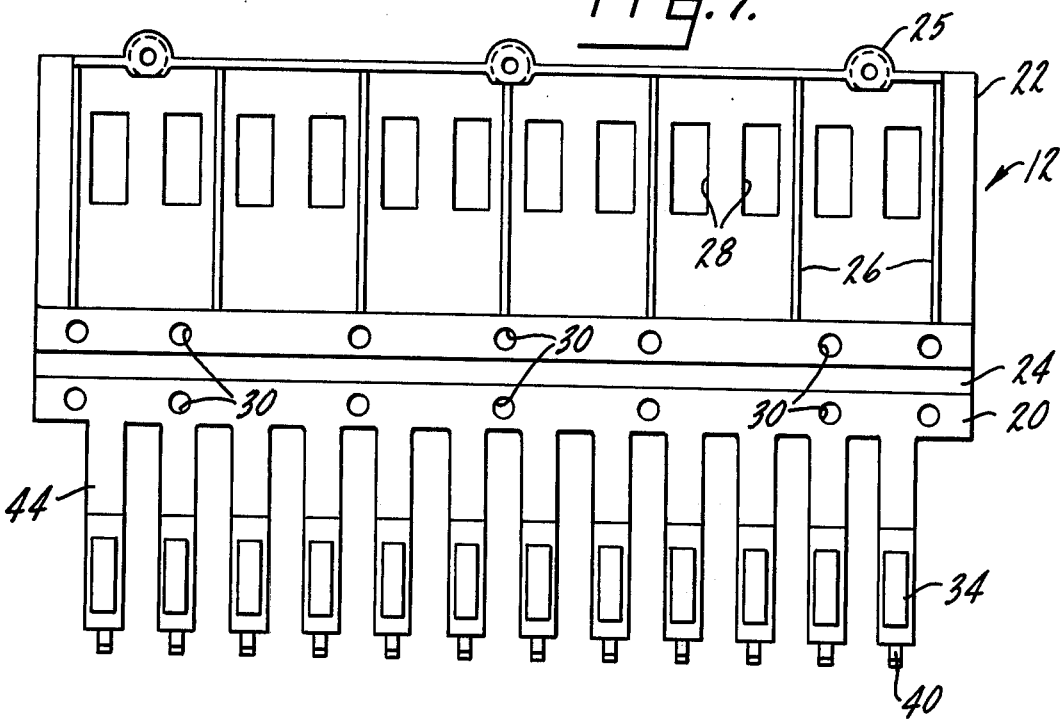
fig. 8.
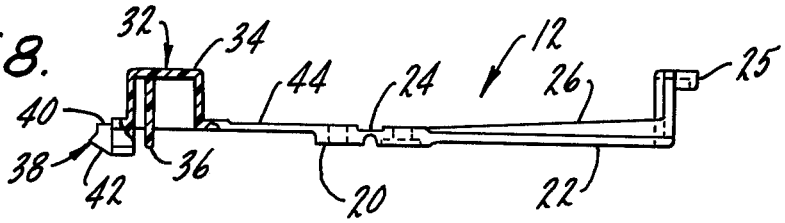
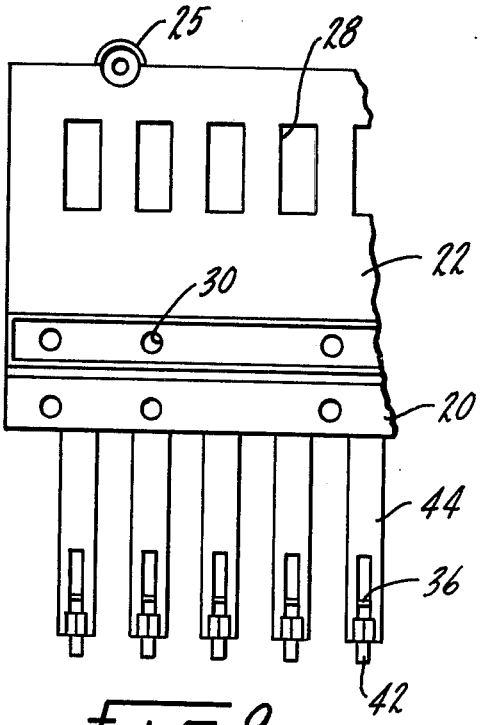
fig. 9.

PUSHBUTTON SWITCH MECHANISM HAVING BLOCK OUT MEMBERS WITH COMMON MOUNTING AND DISCRETE LATCH BAR

SUMMARY OF THE INVENTION

The present invention relates to pushbutton switch mechanisms and particularly to a simply constructed reliably operable pushbutton mechanism having a minimum number of molded parts.

A primary purpose of the invention is a pushbutton switch mechanism of the type described in which the buttons are integrally molded with a portion of the housing, with the connection between the housing and buttons being formed by integrally molded spring arms.

Another purpose is a pushbutton switch mechanism of the type described in which blockout members are integrally molded with one of the housing sections.

Another purpose is a pushbutton switch mechanism in which the latch bar is fixed against lateral or longitudinal movement, but pivots to latch depressed buttons.

Another purpose is a pushbutton switch mechanism of the type described including specifically contoured buttons arranged for cooperation with a pivotally movable latch bar.

Another purpose is a pushbutton switch mechanism having a pair of housing sections, with the buttons being integrally molded with one section and blockout members being integrally molded with the second section.

Another purpose is a bushbutton switch mechanism of the type described in which each of the housing sections are molded in a flat or laid-out condition and in which adjacent portions are folded together in assembly.

Other purposes will appear in the ensuing specification, drawings and claims.

BRIEF DESCRIPTION OF THE DRAWINGS

The invention is illustrated diagrammatically in the following drawings wherein:

FIG. 7 is a top view of the housing cover section, FIG. 8 is a side view of the structure of FIG. 7, FIG. 9 is a partial bottom view of the structure of the cover section.

DESCRIPTION OF THE PREFERRED EMBODIMENT

Figure 1:
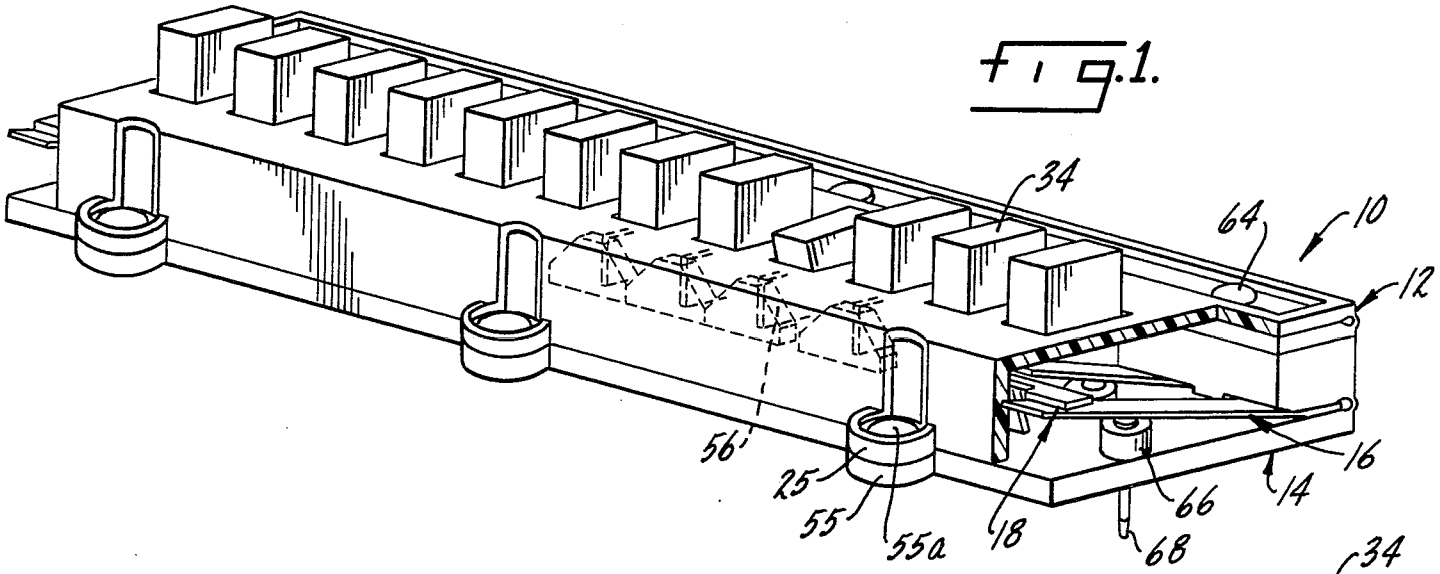
FIG. 1 is a perspective view of a switch mechanism of the type described.

In FIG. 1 a housing is indicated generally at 10 and includes a housing cover section 12 and a base section 14. Within the housing 10 is a contact arm structure 16 illustrated in detail in FIGS. 10 and 11. A latch bar 18 is pivotally movable within the housing 10, with the latch bar being illustrated in detail in FIGS. 12, 13 and 14.

Looking specifically at FIGS. 7, 8 and 9, the housing cover section 12 includes a button portion 20 and a cover portion 22 integrally molded together and joined by a hinge 24. There are spacing ribs 26 in the cover portion 22 and openings 28 which are aligned to receive individual buttons. The cover portion 22 and button portion 20 have aligned holes 30 which are used for properly positioning and assembling the cover and base sections of the housing. The side of cover section 12 opposite hinge 24 has spaced assembly bosses 25.

Integrally molded with the button portion 20 are a plurality of individual buttons 32, each of which include an upper cap or cover 34 and a downwardly-extending projection 36 which is used to cause operation of the individual contact arms. At the front of each button 32 is a nose portion 38 having an upper portion 40 and lower tapered surface 42, which are arranged and designed to cooperate with the latch bar, as will appear hereinafter. In assembly, the portions 20 and 22 are folded upon each other such that the individual buttons 32 extend through openings 28, as particularly illustrated in FIGS. 1 and 3. The section 12 may be conveniently molded of a suitable plastic which has a sufficient degree of resilience such that the individual buttons 32 are supported by integral spring-like arm sections 44, with the arm sections 44 providing the return spring force after the buttons have been released.

Figure 4:
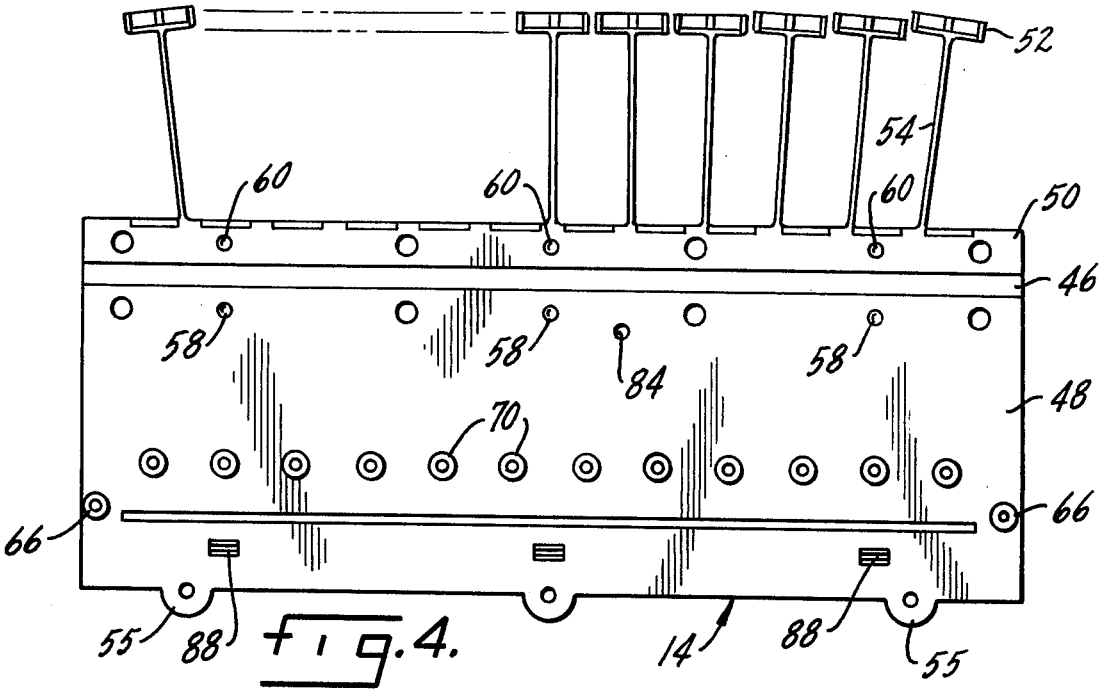
FIG. 4 is a top plan view of the base section of the housing.
Figure 5:
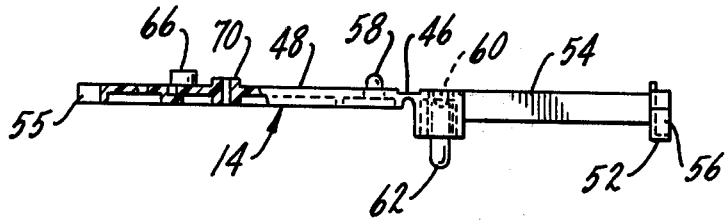
FIG. 5 is a side view, in partial section, of the structure of FIG. 4.
Figure 6:
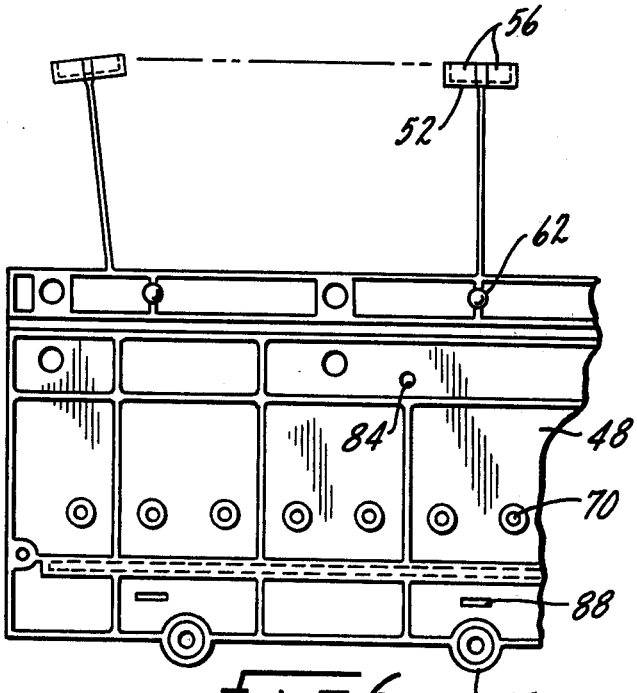
FIG. 6 is a partial bottom view of the base section.

The base section of the housing is illustrated in FIGS. 4, 5 and 6. A hinge 46 joins a base portion 48 and a blockout portion 50. Integrally molded with the blockout portion 50 are a plurality of individual blockout members 52 supported on arms 54 integral with the blockout portion 50. The particular spacing of the blockout members 52 and their size and arrangement is so designed that the blockout members cooperate with the individual buttons in the normal manner to achieve a blockout function. In this connection, as shown in FIG. 1, each of the blockout members 52 have a wedge-shaped appearance with tapering side walls 56 to cause sidewise movement of each of the blockout members when an individual button is depressed.

Figure 3:
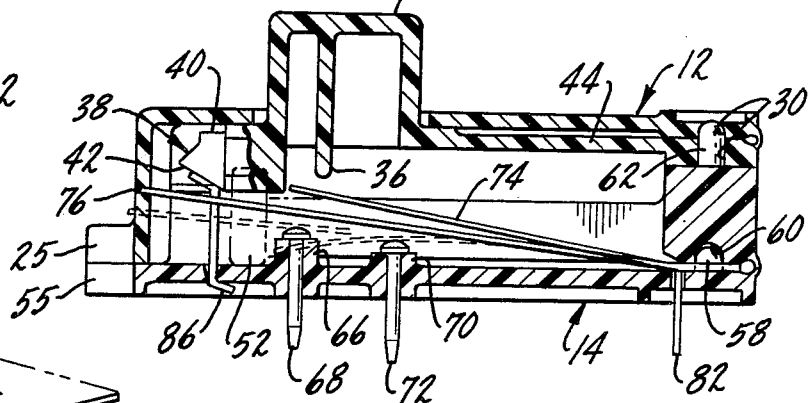
FIG. 3 is a side view, in partial section, of the structure of FIG. 1.

There are a plurality of pins 58 immediately adjacent hinge 46 and formed in the base portion 48. These pins will be received in mating sockets 60 when the two portions are folded, one upon the other, as shown in FIGS. 1 and 3. In like manner, ther are elongated pins 62 on the opposite side of section 14, which pins pass through holes 30 in the cover section 12 to align and position the two housing sections relative to each other during assembly. Spaced assembly bosses 55, on the edge of section 14 opposite hinge 46, cooperate with bosses 25 on cover section 12 to secure assembly with pins 55*a*. In addition to the above-described means for aligning and securing the housing sections together, there may be a plurality of individual pins 64 which extend downwardly through the cover housing section and the base housing section to fasten the sections into a permanent assembled structure.

Extending upwardly, as shown in FIGS. 1 and 3, from the base section 14 is a pair of spaced bosses 66, each of which mount contact terminals in the shape of pins 68. The pins 68 are for use in providing momentary contact with a portion of the contact arm structure as will appear hereinafter. There are two such pins 68 and two such bosses 66. Also extending upwardly from the base section 14 is a series of bosses 70, each of which mount contact pins 72 or terminals which are positioned for contact by the plurality of individual spring arms integral with the contact member 16, again as will appear hereinafter.

Figure 10:
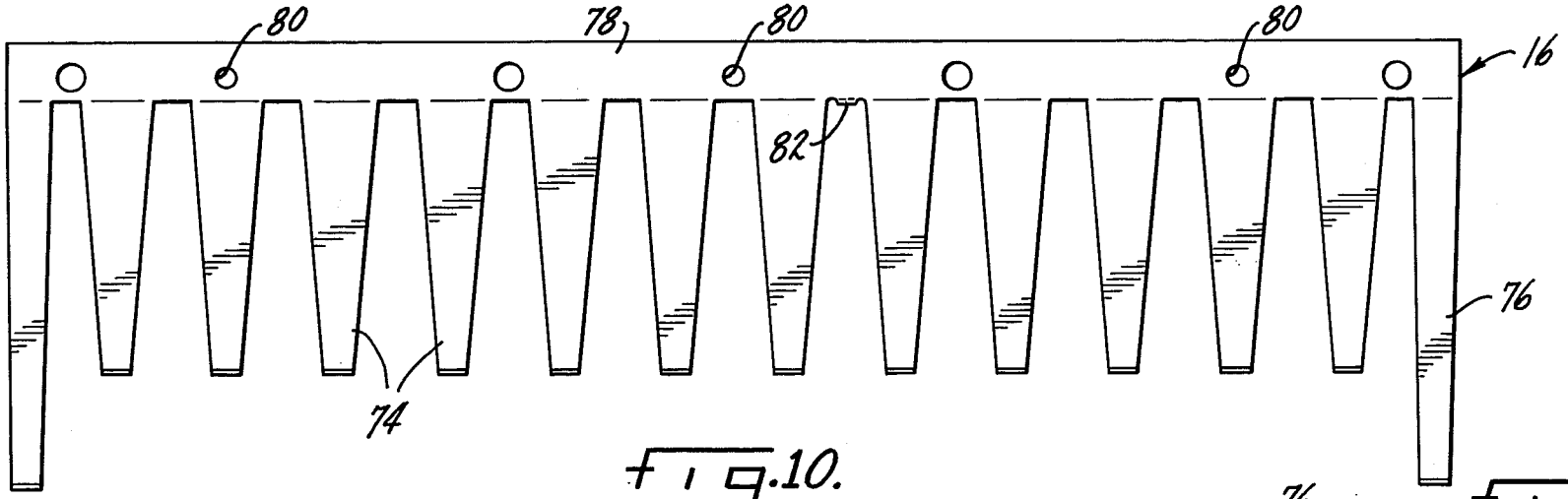
FIG. 10 is a top plan view of the contact arm structure.
Figure 11:
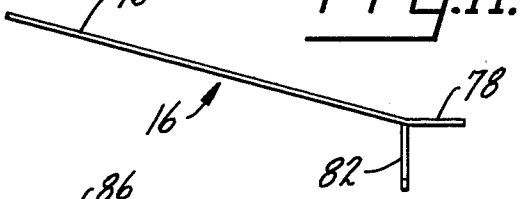
FIG. 11 is a side view of the structure of FIG. 10.

FIGS. 10 and 11 show the contact arm structure 16 and it includes a series of individual spring-like contact arms 74, each of which will be arranged for movement by one of the buttons 32. At the outside of the contact arm structure there are a pair of longer arms 76 which are arranged for contact with terminals 68. In one particular use of the present switch structure, in a cable television converter, the arms 74 and their associated buttons are for purposes of channel selection. The arms 76 will both be operated any time a button is depressed and will provide momentary contact to close a muting switch in the converter. Each of the arms 74 and 76 are integral with a base member 78 which is positioned between the opposite halves or portions of the base section 14, as particularly shown in FIGS. 1 and 3, such that the contact structure is firmly held to the housing structure. The pins 58 on base housing section portion 48 will extend through openings 80 in the body portion 78. The lower downwardly-extending terminal arm 82 of the contact arm structure 16 will pass through an opening 84 in portion 48 of the base housing structure.

Figure 12:
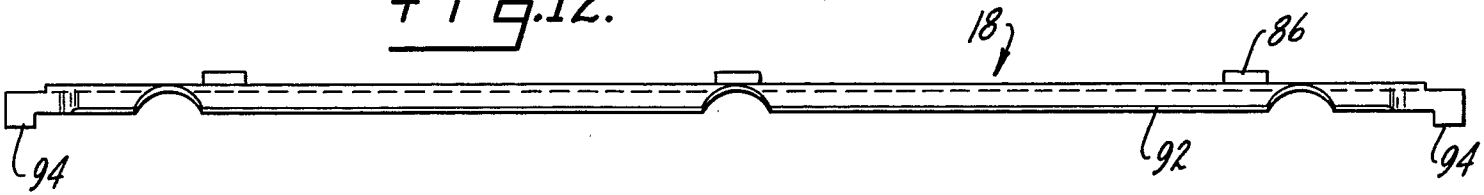
FIG. 12 is a top view of the latch bar.
Figure 13:
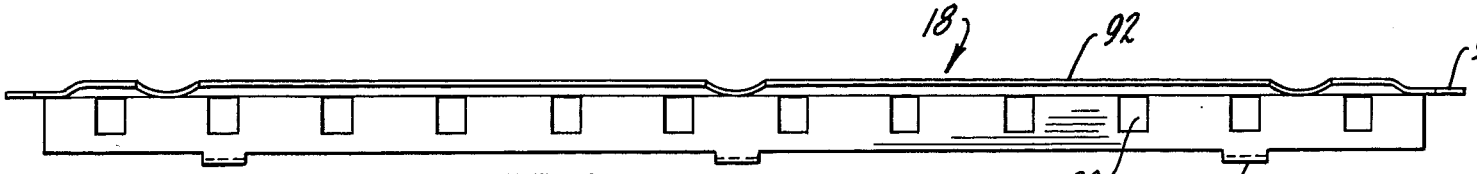
FIG. 13 is a front view of the latch bar.
Figure 14:
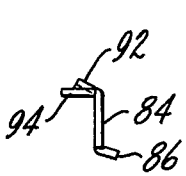
FIG. 14 is a side view of the latch bar.

The latch member, as shown in FIGS. 12, 13 and 14, includes a bent body portion 84 with three locking lugs 86 formed and adapted to be received within openings 88 in the housing section portion 48. The interlock between the latch member and the housing permits pivotal movement, but prevents lateral or longitudinal movement of the latch bar relative to the housing. The body portion 84 may have a plurality of openings 90 which will receive the button nose section described above when an individual button is depressed. The upper side 92 of the body portion 84 has a slight angle, as clearly shown in FIGS. 3, 13 and 14, which angle generally approximates the bottom tapered edge 42 of the nose of each button. Thus, downward movement of the button will cause the latch bar to pivot about its locking lugs 86. At the far outer ends of the latch bar are a pair of arms 94 which are positioned to depress the arms 76 on the contact member 16.

Figure 2:
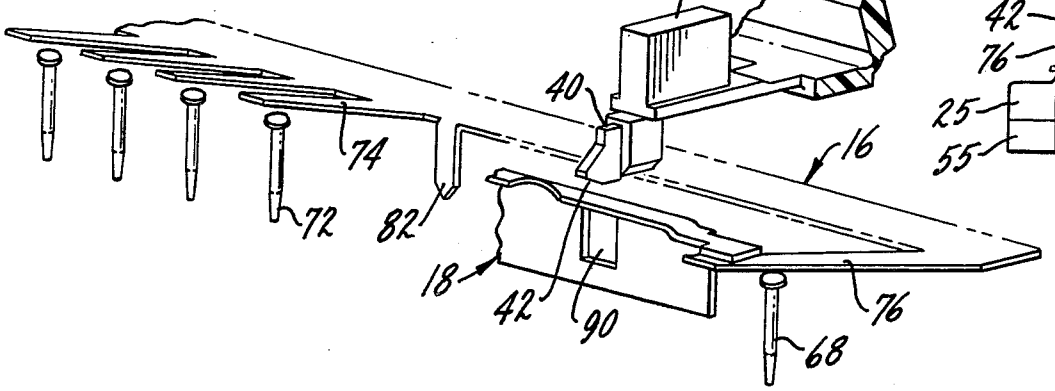
FIG. 2 is a partial perspective showing the cooperation between the contact arms and switch buttons.

In operation, and considering particularly FIGS. 1, 2 and 3, when any individual button is depressed, as the button moves downwardly, the lower tapered surface 42 of the nose of each button will cause the latch bar 18 to pivot downwardly and outwardly about its mounting locking lugs 86. As the button moves down and the latch bar pivots, the arms 94 on the end of the latch bar will strike the contact arm, depressing these arms to the dotted line position of FIG. 3 where it is seen that they make electrical and mechanical contact with terminals 68. This is a momentary type of contact which is released once the latch bar returns to its original position.

As the button moves downwardly and the latch bar pivots, the button nose will pass through one of the openings 90 to the point where the button nose will be beneath the latch bar and the upper surface 40 of the button nose will be interlocked or engaged by the surface of the latch bar adjacent opening 90 or by the upper side 92 of the latch bar when the button is released. Thus, the button will be held in a depressed condition or position by the interlock between the button nose and the latch bar. When the latch bar returns to its original position, contact arms 76 will be released from their momentary contact with terminal 68. However, the individual contact arm 74, which is depressed by projection 36 on the particular button depressed, will have moved down to the dotted line position of FIG. 3 where contact is made between that arm and terminal 72. This contact will remain as long as the button is held in its depressed position by the latch bar. Normally, terminals 68 and 72 and the single terminal arm 82 of the contact arm structure 16, will all be mounted in a conventional printed circuit board.

When a second button is depressed, the action of that particular button will be the same as described. However, as the latch bar pivots it will release the first depressed button which will then return, due to return spring force provided by arm 44, to its normal release position as shown in FIG. 1.

As an individual button is depressed, and locking particularly at FIG. 1, that portion of the button just behind the nose will strike opposing tapered walls 56 of adjoining blockout members 52. These particular blockout members will thus be spread causing all of the blockout members to be pushed closer together in opposite directions away from the particular button that is depressed. This will prevent the simultaneous operation of more than one button as is conventional in blockout arrangements. The wedge-shaped blockout members will be moved sidewise when a button is depressed, causing a consequent bunching of adjoining blockout members on each side of the depressed button.

Of importance in the invention is the fact that there is provision for a number of switching operations with a relatively simple and inexpensive overall switching structure. The housing is formed of two non-metallic sections, for example a suitable plastic. The two non-metallic sections are each molded in an unfolded condition, with one section including integral buttons and openings for the buttons and the other section including integral blockout members. This avoids the necessity of fastening, attaching or otherwise mounting the individual buttons or blockout members. They are integral with the housing sections. In the case of the cover section not only are the buttons integral with the cover section, but so are the spring arms which mount the buttons and provide the return spring force. When the housing cover section is assembled, it is folded so that the integral buttons pass through the openings formed in the other portion of the cover section. In like manner, when the base section is folded in assembly, the blockout members are appropriately arranged relative to the buttons with the entire combination of the two sections being properly positioned and aligned by pin and socket mounting means. When the base section is folded, the contact arm structure is placed within the fold and over the mounting pins in the base section so that the contact arm structure is firmly and properly positioned relative to the entire assembly.

Of importance relative to the latch member is the fact that it does not slide or reciprocate or longitudinally move, as is conventional. Rather, a simple pivotal or rocking movement provides the necessary latching and unlatching functions when the buttons are depressed.

When the invention is used in a cable television converter, the individual button may function as channel selecting means. The contact arm 76 may provide momentary muting during the period that channel selection is being made.

Whereas the preferred form of the invention has been shown and described herein, it should be realized that there may be many modifications, substitutions and alterations thereto.

The embodiments of the invention in which an exclusive property or privilege is claimed are defined as follows:

1. A pushbutton switch mechanism including a housing, a plurality of terminals positioned in said housing, a plurality of individual contact arms positioned for contact with said terminals, said housing including a cover section having a cover portion and a button portion joined by an integral hinge, a plurality of buttons integrally formed with spring arms, said buttons and button spring arms being integrally formed with said button portion, said cover portion including openings, with said portions being folded one upon the other when said cover section is assembled, with the buttons extending through the button openings.

2. The structure of claim 1 further characterized by and including a latch bar positioned within said housing and having portions thereof arranged for cooperation with said buttons for holding any button in a depressed position.

3. The structure of claim 2 further characterized in that each button has a nose portion positioned for cooperation with said latch bar, with initial contact between said nose portion and latch bar causing said latch bar to pivotally move within said housing.

4. The structure of claim 3 further characterized in that said latch bar includes a plurality of openings, there being an opening aligned with each button, the nose portion of each button including a lower tapered surface for pivotally moving said latch bar upon contact therewith, and an upper latching surface.

5. The structure of claim 3 further characterized in that each button includes a projection, spaced from said nose portion, for use in contacting one of said contact arms.

6. The structure of claim 2 further characterized in that at least one of said contact arms has a length greater than that of the remaining contact arms, said latch bar having a portion positioned for contact with said longer contact arm for causing movement thereof upon depression of any button and subsequent pivotal movement of said latch bar.

7. The structure of claim 2 further characterized in that said housing includes a base section, joined to said cover section, with said base section including a plurality of individual integral blockout members positioned between and disposed for contact by adjacent buttons.

8. The structure of claim 7 further characterized in that said base section includes a portion integrally formed with said blockout members and a second portion, said portions being joined by an integral hinge.

9. The structure of claim 8 further characterized in that said contact members are positioned between said base section portions when one of said portions is folded back upon the other.

10. The structure of claim 7 further characterized in that said base section has a plurality of outwardly-extending integral pins socketed in mating recesses in said cover section.

11. The structure of claim 7 further characterized by and including a plurality of sockets in said base section, each of said terminals being positioned in a socket.

12. A pushbutton switching mechanism including housing, a plurality of terminals positioned in said housing, a plurality of individual contact arms positioned for contact with sai terminals, a plurality of buttons movably supported by said housing, depression of said buttons closing said contact arms with said terminals, an elongated latch bar pivotally mounted in said housing and having a plurality of openings, there being an opening aligned with each button, each button being positioned for contact with said latch bar, with movement of a button into contact with said latch bar causing said latch bar to pivotally move within said housing, each button having a portion to initially cause movement of said latch bar, and a second latching portion positioned to extend through an opening and form an interlock with said latch bar after initial movement thereof.

13. The structure of claim 12 further characterized by and including cooperating means on the housing and latch bar, preventing longitudinal movement of said latch bar.

14. A pushbutton switching mechanism including a housing, a plurality of terminals positioned in said housing, a contact member in said housing having a plurality of individual arms positioned for contact with said terminals, a plurality of buttons movably supported by said housing, depression of said buttons closing said contact arms with said terminals, a plurality of blockout members integrally joined together into a unitary structure, said blockout members being positioned between and disposed for contact by adjacent buttons.

15. The structure of claim 14 further characterized in that said housing includes a base section, said blockout members being integrally molded with said base section, said base section including spaced portions joined by a hinge, with said blockout members being integrally molded to one of said spaced portions.

16. The structure of claim 15 further characterized in that said contact member is positioned between said base section spaced portions, when one is folded upon the other, to mount said contact member in said housing.

* * * * *